United States Patent [19]

Clausell

[11] 4,077,623

[45] Mar. 7, 1978

[54] EXERCISING GAME APPARATUS

[76] Inventor: Joseph Clausell, 27-86 Dewey Ave., Apt. 6B, Bronx, N.Y. 10465

[21] Appl. No.: 706,265

[22] Filed: Jul. 19, 1976

[51] Int. Cl.[2] ..... A63B 5/08; A63B 7/02

[52] U.S. Cl. ..... 272/61; 272/65

[58] Field of Search ..... 272/70, 116, 109, 95, 272/112, 101, 65, 61; 273/142 G, 142 R; 5/110, 111; 135/16; 128/25 R, 25 B

[56] References Cited

U.S. PATENT DOCUMENTS

| | | | |
|---|---|---|---|
| D. 187,138 | 2/1960 | Highberger | 272/65 |
| 2,743,146 | 4/1956 | Wheeler | 135/16 X |
| 2,764,766 | 10/1956 | Boyle et al. | 272/65 |
| 2,961,235 | 11/1960 | Blanchard | 272/65 |
| 3,011,782 | 12/1961 | Weinberg | 272/65 |
| 3,397,881 | 8/1968 | Hedgecock | 272/46 X |
| 3,683,898 | 8/1972 | Underwood | 128/25 R |

*Primary Examiner*—Wiliam H. Grieb

*Assistant Examiner*—William R. Browne

*Attorney, Agent, or Firm*—Robert D. Farkas

[57] ABSTRACT

A circular trampoline supported by a frame, a flexible sheet comprising the surface of the trampoline adapted for exercising use having a central opening therein. A column is disposed vertically passing through the opening, carrying a canopy over a superstructure having a plurality of trapezes suspended downwardly therefrom. The trapezes extend over the flexible sheet of the trampoline. The column may be rotatably secured to the frame supporting the flexible sheet. A collar is affixed to the flexible sheet about the periphery of the opening. A line is provided to displace the central regions of the flexible sheet downwardly in a non-exercising conical position so as to enable the apparatus to be utilized in playing games, such as roulette, by having one end of the line being secured to the collar and having portions of the line releasably secured to a cleat affixed to the frame.

11 Claims, 3 Drawing Figures

Fig. 1
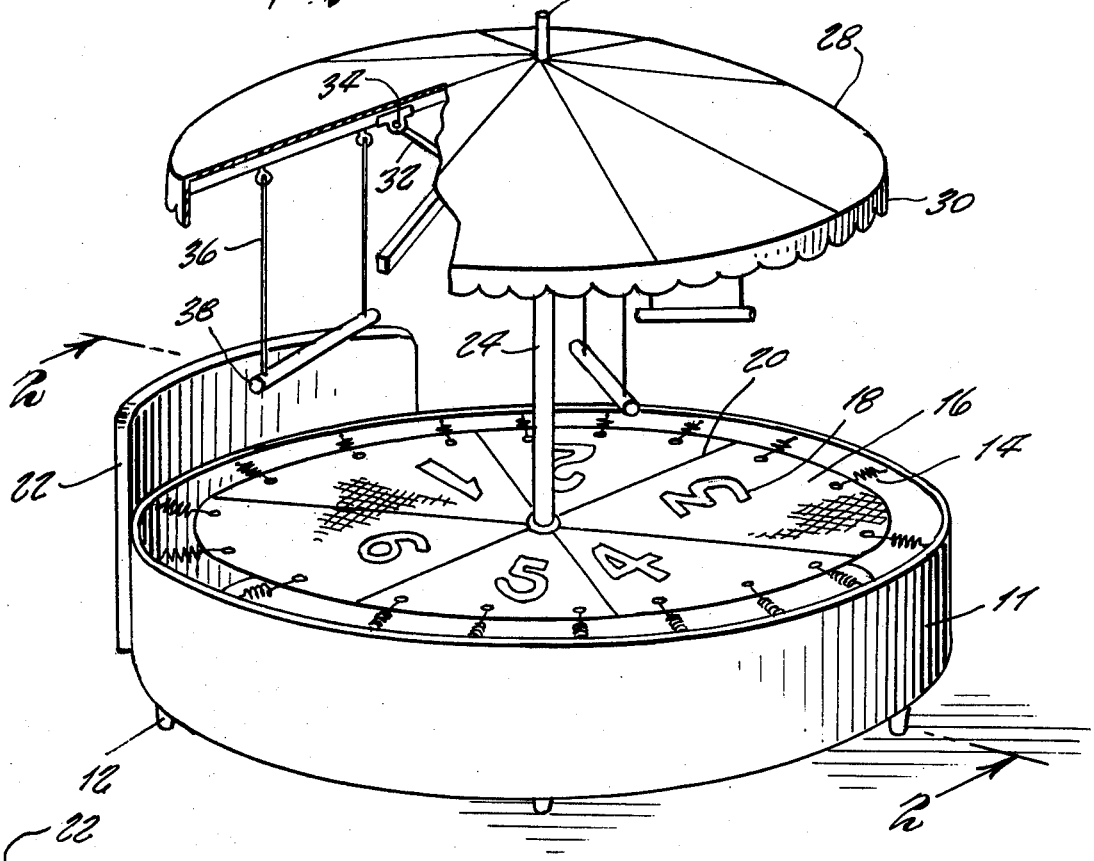
Fig. 2
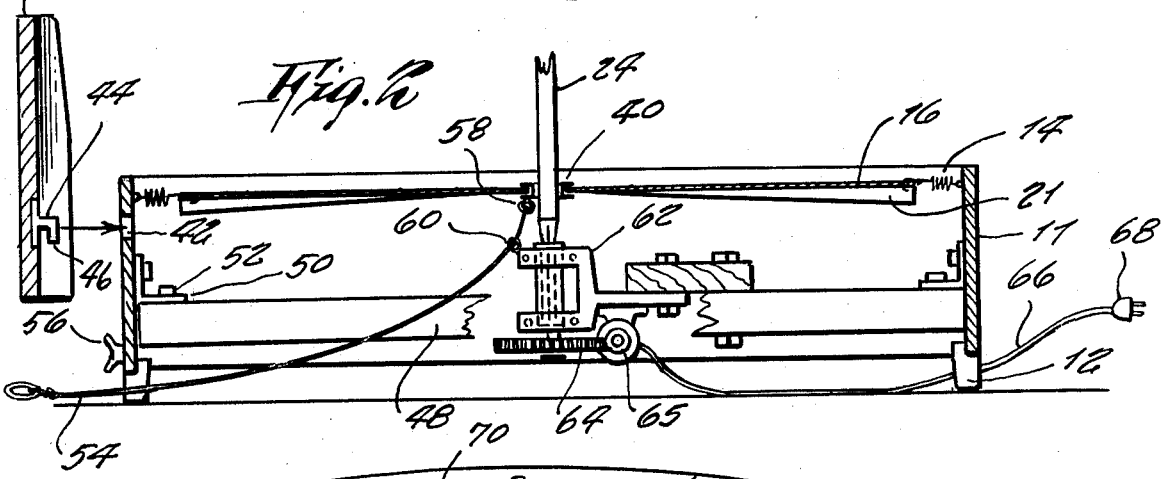
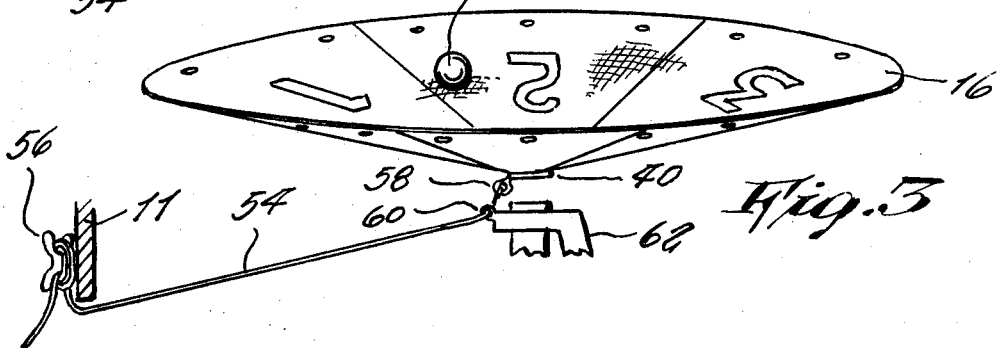
Fig. 3

EXERCISING GAME APPARATUS

BACKGROUND OF THE INVENTION

Field of the invention

This invention relates to trampolines and, in particular, to trampolines having multiple uses.

Prior Art

Bouncing beds or trampolines have been in use for many years by gymnasts. In recent years, increasingly widespread trampoline use has encouraged inventors to disclose improvements in construction of such devices.

SUMMARY OF THE INVENTION

It is therefore an object of this invention to overcome the limitations and disadvantages in the trampoline devices in the prior art and currently available in the market.

One of the objects of the invention is to provide a trampoline device embodying improved principles of design and construction.

An important object of the invention is to provide a trampoline device which is comprised of a number of simple durable parts or components which can be economically manufactured and readily assembled.

A significant object of the invention is to provide a trampoline device, so designed and constructed that it can be readily used by almost anybody.

Another object of the invention is to provide a trampoline which may be used as a bed.

A further object of the invention is to provide a trampoline which can be used to play roulette.

Yet another object of the invention is to provide further exercise and play facilities by the use of overhead swinging bars.

A bed, according to the principles of this invention, comprises a frame, flexible elements, a taut decorated sheet having a central hole, a vertical pole frame rotatably driven and supporting an umbrella and at least one trapeze suspended therefrom, removable walls supported at the periphery of the frame, center depression means and a ball for playing games upon the decorated sheet.

Further objects and advantages of this invention will appear more clearly from the following description of a non-limiting illustrative embodiment and the accompanying drawings in which like numerals designate like parts throughout the several views.

BRIEF DESCRIPTION OF THE DRAWING

Briefly summarized, a preferred embodiment of the invention is described in conjunction with an illustrative disclosure thereof in the accompanying drawings, in which:

FIG. 1 is a pictorial representation of the trampoline and overhead super-structure with trapezes according to the principles of this invention, FIG. 2 is a cross sectional view taken substantially along plane 2—2 in FIG. 1; and FIG. 3 is a partial view of a distorted flexible sheet.

DETAILED DESCRIPTION OF THE PREFERRED EMBODIMENT

In the drawings a trampoline embodying features of the invention is illustrated comprising frame 11 supported on feet 12 and suspending flexible sheet 16 by flexible elements such as springs 14 which is adequate for bouncing and tumbling fun exercises. The flexible sheet 16 may be decorated on its upper surface by division lines 20 into specific areas indicated by numerals 18 and employed for playing any game requiring such designated areas, of which roulette is a particular example which may be played by using a ball 70 freely rolling until it stops on one of the numbered areas. Stiffeners 21 may be provided, preferably under lines 20. The ball path and resting place may be restricted towards the center of the flexible sheet 16 by depressing the center of the sheet by having specific depressing means such as a pull cable 54 passing thru guides 58, 60 and pulling upon a collar 40 at the sheet center. The pull cable 54 may be tied about cleat 56 for storage purposes or to maintain cable tension.

A vertical wall 22 may be provided for attachment to frame 11 by known means such as hooks 44, 46 fitting into hole 42. Wall 22 may serve as a headboard when the device is used as a bed, or may serve as a safety enclosure and may be extended all around the frame.

A column 24 may be provided, extending vertically over the uppermost surface of the flexible sheet, for supporting an superstructure 32, 34 from which additional exercise devices such as horizontal bars 38 may be mounted, either fixed, or suspended on lines 36 so as to form a trapeze.

The column may be topped out with a covering such as an umbrella 28 which may be decorated or fringed 30 and topped with a point 26.

A beam 48 attached to frame 11 by brackets 50 and fasteners 52 may be used to support the column; the column 24 may be mounted in a yoke 62.

For additional interest, the column 24 may be rotatable either manually or mechanically by a drive such as gears 64 which may be driven by an electric motor 65 which may obtain power from an electrical energy source via conductor 66 and connector 68.

Feet 12 may be made adjustable to assist in leveling the frame.

Many games with suitable playing rules may be developed employing this equipment.

The trampoline and its associated parts may be manufactured by known methods of known materials.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

I claim:

1. An exercising game apparatus comprising a frame, a flexible sheet, a column, said flexible sheet being supported by said frame, means to maintain the peripheral edges of said flexible sheet taut by having said peripheral edges of said sheet urged outwardly from the central regions of said flexible sheet, said flexible sheet having an opening therein, said column being disposed in a vertical position having a portion thereof passing through said opening, means to fasten said column to said frame, a superstructure, said superstructure being fastened adjacent the uppermost end of said column, a plurality of trapezes, said plurality of trapezes being supported by said superstructure and depending downwardly therefrom, a cable, one end of said cable fixedly secured to said flexible sheet at a location adjacent said opening therein, means to removably secure a portion of said cable to said frame, said flexible sheet being urged into a truncated conical shape when said cable is pulled downwardly from a plane defining the surface of said flexible sheet when in a planer condition, said plurality of trapezes residing in an area defined by said peripheral edges.

2. The exercising game apparatus as claimed in claim 1 wherein said fastening means comprises a beam, said beam being fixedly secured to said frame, a portion of said column being secured to said beam.

3. The exercising game apparatus as claimed in claim 1 wherein said column is rotatably secured to said frame.

4. The exercising game apparatus as claimed in claim 3 further comprising an electric motor, said motor having an output shaft, said output shaft being coupled to said column to impart a rotary motion thereto.

5. The exercising game apparatus as claimed in claim 1 further comprising an umbrella, said umbrella carried by said column.

6. The exercising game apparatus as claimed in claim 1 wherein said removable securing means comprises a cleat, said cleat fixedly secured to said frame.

7. The exercising game apparatus as claimed in claim 1 further comprising a collar, said collar fixedly secured to said sheet about said opening, said one end of said cable fixedly secured to said collar.

8. The exercising game apparatus as claimed in claim 1 further comprising a plurality of stiffener elements, said stiffener elements being secured to said flexible sheet and extending radially outwardly from said opening.

9. The exercising game apparatus as claimed in claim 1 further comprising indicia, said indicia being disposed on an uppermost surface of said flexible sheet, said indicia including a plurality of lines extending radially outwardly from said opening.

10. The exercising game apparatus as claimed in claim 1 wherein each of said trapezes comprise a rod, a pair of lines, one end of each of said lines secured to the ends of said rod, each of the other ends of said lines being secured to said superstructure, the longitudinal axis of said each of said rods extending radially outwardly from the longitudinal axis of said column.

11. The exercising game apparatus as claimed in claim 1 further comprising a wall, means to removably secure said wall to said frame.

* * * * *